US011939784B2

(12) United States Patent
Tryland et al.

(10) Patent No.: US 11,939,784 B2
(45) Date of Patent: Mar. 26, 2024

(54) TOWER SECTION FOR A TRUSS TOWER, A TRUSS TOWER, A TRUSS TOWER ASSEMBLY, AND USE OF SUCH SECTION, TOWER AND TOWER ASSEMBLY

(71) Applicant: Hyndla AS, Sandvika (NO)

(72) Inventors: Tore Tryland, Raufoss (NO); Magnus Kjepso Halvorsen, Moss (NO)

(73) Assignee: HYNDLA AS, Sandvika (NO)

( * ) Notice: Subject to any disclaimer, the term of this patent is extended or adjusted under 35 U.S.C. 154(b) by 40 days.

(21) Appl. No.: 17/633,801

(22) PCT Filed: Sep. 3, 2020

(86) PCT No.: PCT/NO2020/050223

§ 371 (c)(1),
(2) Date: Feb. 8, 2022

(87) PCT Pub. No.: WO2021/049945

PCT Pub. Date: Mar. 18, 2021

(65) Prior Publication Data

US 2022/0298819 A1 Sep. 22, 2022

(30) Foreign Application Priority Data

Sep. 13, 2019 (NO) ..... 20191100

(51) Int. Cl.
*E04H 12/10* (2006.01)
*E04C 3/04* (2006.01)
*E04H 12/24* (2006.01)

(52) U.S. Cl.
CPC ..... *E04H 12/10* (2013.01); *E04H 12/24* (2013.01); *E04C 2003/0417* (2013.01); *E04C 2003/0469* (2013.01)

(58) Field of Classification Search
CPC ..... E04C 3/08; E04C 2003/0469; E04C 2003/0495; E04H 12/10; E04H 12/24; H01Q 1/1242
See application file for complete search history.

(56) References Cited

U.S. PATENT DOCUMENTS 134,987 A * 1/1873 Herman ..... E04B 1/19 52/651.09
1,676,161 A * 7/1928 Schiller ..... E04H 12/10 187/242

(Continued)

FOREIGN PATENT DOCUMENTS

CA 2797664 A1 * 5/2014 ..... E04H 12/10
EP 0407998 1/1991

(Continued)

OTHER PUBLICATIONS

Norwegian Search Report for NO 20191100, dated Mar. 31, 2020.
International Search Report and the Written Opinion for PCT/NO2020/050223, dated Nov. 1, 2021.

*Primary Examiner* — Christine T Cajilig
(74) *Attorney, Agent, or Firm* — Andrus Intellectual Property Law, LLP

(57) ABSTRACT

A tower section is for a truss tower. The tower section has three or more elongated corner beams arranged in parallel and spaced apart, and a plurality of transverse beams connected perpendicular to adjacent corner beams, thereby forming respective three or more sides. The transverse beams are distributed along the sides so that the transverse beams of one of the side are arranged offset to the transverse beams of the other sides.

13 Claims, 5 Drawing Sheets

(56) References Cited

U.S. PATENT DOCUMENTS

| | | | | |
|---|---|---|---|---|
| 3,226,904 | A * | 1/1966 | Itoh | E04C 3/09 52/650.2 |
| 4,745,412 | A | 5/1988 | Creaser, Jr. | |
| 5,084,919 | A * | 2/1992 | Bittel, Sr. | E04H 4/144 4/496 |
| 5,870,877 | A | 2/1999 | Turner | |
| 2004/0000620 | A1 * | 1/2004 | Schipani | A47F 5/13 248/50 |
| 2010/0251634 | A1 * | 10/2010 | Diniz | E04H 12/182 52/111 |
| 2011/0209947 | A1 * | 9/2011 | Allred, III | E06C 7/50 182/194 |
| 2012/0255255 | A1 * | 10/2012 | Lin | E04C 3/08 52/655.1 |

FOREIGN PATENT DOCUMENTS

| | | | | |
|---|---|---|---|---|
| FR | 2549885 | A1 * | 2/1985 | |
| GB | 567852 | | 3/1945 | |
| GB | 2116615 | | 11/1983 | |
| NO | 912700 | | 1/1993 | |
| WO | 9415041 | | 7/1994 | |
| WO | WO-9415041 | A1 * | 7/1994 | E01D 6/00 |

* cited by examiner

TOWER SECTION FOR A TRUSS TOWER, A TRUSS TOWER, A TRUSS TOWER ASSEMBLY, AND USE OF SUCH SECTION, TOWER AND TOWER ASSEMBLY

CROSS-REFERENCE TO RELATED APPLICATIONS

This application is the U.S. national stage application of International Application PCT/NO2020/050223, filed Sep. 3, 2020, which international application was published on Mar. 18, 2021, as International Publication WO 2021/049945 in the English language. The International Application claims priority of Norwegian Patent Application No. 20191100, filed Sep. 13, 2019. The international application and Norwegian application are both incorporated herein by reference, in entirety.

INTRODUCTION

The present invention relates to a tower section for a truss tower. The tower section comprises three or more elongated corner beams arranged in parallel and spaced apart, and a plurality of transverse beams connected perpendicularly to adjacent corner beams. The transverse beams are distributed along the adjacent corner beams and thereby forming respective three or more sides.

The present invention also relates to a truss tower and a truss tower assembly comprising the tower section of the invention, and use of the tower section, the truss tower and the truss tower assembly.

PRIOR ART

Truss towers are used in various applications, such as for high-voltage transmission towers, where the towers support transmission cables, such as 132 kV three-phase alternating current lines as present for the Norwegian grid, or different voltage standards.

Firstly, a problem with prior art truss towers is the cost of installing the towers. Transmission towers often have to be transported to the installation site by helicopter, and the speed and cost of installation is highly related to the effectiveness of the helicopter transportation. Weight determines transportation effectiveness, and a light-weight truss-based structure is desirable for faster and cheaper installation.

Secondarily, there is a need for improved health, safety, and environmental conditions in installation and operation of high-voltage transmission towers. Current solutions are potentially hazardous to work with and to the environment (wood, fiber reinforced plastic), are dangerous to install (steel), or have limited recyclability (fiber reinforced plastic, steel).

There are four known technologies: transmission towers built in wood, steel, fiber reinforced plastic, and simpler aluminum structures.

The wooden transmission tower has been known for decades, and has been widely used, particularly in challenging topography. While relatively low-weight and cost-effective, the material has to be treated with creosote, which is a toxic chemical whose use is banned within the EU. In addition, the material is not very scalable as cost escalates exponentially as the size of the tower increases.

The steel transmission tower has been known for decades, too, and is the most used solution globally. Steel towers come as both tubular, one-piece solutions and truss-based solutions. While very cost-effective to procure, steel does not facilitate low-weight solutions, both due to its specific weight, but also because it is difficult to make closed cross sections. Its usage is therefore not favored whenever transportation requirements are challenging.

The fiber reinforced plastic tower has recently appeared on the market as a light-weight alternative to steel and wood. However, fibre reinforced plastic towers are expensive to produce, potentially hazardous to workers and the environment when damaged, cut, or drilled, and not recyclable.

Aluminum towers have been used in to a small degree (e.g. Fairbanks, Alaska (USA), and Norway—once in the 60s, but more recently as tubular poles by Lena Metall AS), but only in simpler designs (open cross-sections or poles) which have had to rely on guys (wires) or limited size or loads to support cables in the 132 kV range. Due to the lack of inventiveness in these solutions, aluminum has never been widely used previously.

Both fiber reinforced plastic and aluminum solutions also suffer from the difficulty in calculating their strength with traditional methods. Full utilization of their favorable properties thus remain out of reach for existing inventions.

Moreover, since fiber reinforced plastic- and wood solutions come in tubular shapes, and have poor strength in joints and smaller details, they require deep excavations to be dug so that they may penetrate the earth's surface by several meters in order to achieve a suitable foundation. With metal material, more effective base connections may be designed, so that simpler rock bolts may be used to fix the tower to the earth's surface. With metals, the excavation option may be used for loose soil surfaces, and the base connection option may be used for rock formation: whichever is more cost-effective.

U.S. Pat. No. 4,745,412 discloses lightweight tower assemblies for antennas and the like.

SUMMARY OF THE INVENTION

The invention has for its object to remedy or to reduce at least one of the drawbacks of the prior art, or at least provide a useful alternative to prior art. In particular, an object of the invention is to provide strong lightweight tower sections for a truss tower.

This object is obtained by means of a tower section for a truss tower, wherein the tower section comprises:

- three or more elongated corner beams arranged in parallel or essentially in parallel and spaced apart, and
- a plurality of transverse beams connected perpendicularly to or essentially perpendicularly to adjacent corner beams, thereby forming respective three or more sides.

The invention is characterized in that the transverse beams are distributed along the sides so that the transverse beams of one of the sides are arranged offset to the transverse beams of the other sides.

The corner beams are configured to be oriented in a vertical position during the use of the truss tower and are configured for bearing the axial load of the truss tower. The transverse beams connect the corner beams and hold the spacing of the corner beams fixed when the tower section is subjected to bending or torsion.

By means of distributing the transverse beams along the sides so that the transverse beams of one of the sides are arranged offset to the transverse beams of the other sides, the structural strength of the tower section in regards to bending or torsion is improved. Thereby, the dimensions of the transverse beams or the number of transverse beams used in the tower section may be reduced in order to reduce the weight of the tower section. The reduced weight of the tower section facilitates installation and transport, such as by a helicopter.

The offset distribution of the transverse beams also facilitates a person climbing the truss tower using the transverse beams, such as for purpose of maintaining the truss tower, transmission cables or other connected components.

According to an embodiment of the invention, the transverse beams are distributed equidistantly along the sides and with an equidistant offset between the sides. By means of an equidistant separation and an equidistant offset a homogenous strength of the tower section is obtained along its length.

According to an embodiment of the invention, the transverse beams and the connections to the corner beams are configured to bear up the weight of a person. The transverse beams are dimensioned for allowing a person climbing the truss tower.

According to an embodiment of the invention, the offset of the transverse beams is configured to enable a person climbing the tower by shifting between sides of the tower. According to an embodiment of the invention, the transverse beams comprise friction enhancing surfaces. The friction enhancing surfaces comprise for example friction ridges or friction notches. By means of the friction enhancing surfaces, climbing the truss tower is facilitated using the transverse beams.

According to an embodiment of the invention, the tower section comprises a plurality of bracing beams connected obliquely to adjacent corner beams. The bracing beams are configured to further provide strength and stability to the truss tower. According to an embodiment the bracing beams are further connected to transverse beams.

According to an embodiment of the invention, the corner beams comprise closed tubular profiles. The tubular profiles provide torsional stiffness while allowing for reduced weight of the tower.

According to an embodiment of the invention, the corner beams comprise fins for connection of the transverse beams.

According to an embodiment of the invention, the transverse beams comprise L-shaped profiles. The L-shaped profiles provide low weight for their use in the tower section, where low or no torsional stiffness is required.

According to an embodiment of the invention, the bracing beams comprises L-shaped profiles. The L-shaped profiles provide low weight for their use in the tower section, where low or no torsional stiffness is required.

According to an embodiment of the invention, wherein at least one of the corner beams, the transverse beams and the bracing beams mainly comprise an extruded aluminium material. In a preferred embodiment of the invention, the whole tower section mainly comprises aluminium. For example, attachment elements, such as bolts or similar may be of other material such as stainless steel. A further advantage with a light-weight metal truss tower, is that attachment to a fundament on the ground, such as plain rock, can be obtained with simple brackets attached to the rock without the need to dig deep holes in the ground to support the truss tower.

According to an embodiment of the invention, the tower section has a length in an interval 5 to 7 meters. According to an embodiment of the invention, the tower section has a weight in an interval 80 to 160 kg. According to an embodiment of the invention, the corner beams, the transverse beams and the bracing beams have a thickness in an interval 4 to 8 mm.

The above object of the invention is further obtained by means of a truss tower comprising a tower section according to any of above embodiments.

According to an embodiment of the invention, the truss tower comprises two or more tower sections connected at their end portions. By connecting two or more tower sections the overall height of the truss tower is adjustable.

According to an embodiment of the invention, the whole truss tower is made of aluminium.

The above object of the invention is further obtained by means of a truss tower assembly for holding one or more transmission cables. The truss tower assembly comprises a first truss tower and a second truss tower according to any of above embodiments. The first truss tower and the second truss tower are configured to be supported spaced apart on a bearing surface, wherein the truss tower assembly further comprises a transverse bar arranged between an end portion of the first truss tower and an end portion of the second truss tower.

According to an embodiment of the invention, the transverse bar is arranged extending parallel with a side of a tower section of the first truss tower and parallel with a side of a tower section of the second truss tower. By means of arranging the transverse bar along two sides stresses subjected to the first and second towers from an entity connected to the transverse bar are preferable for the truss tower assembly.

According to an embodiment of the invention, the transverse bar comprises connection means for holding one or more transmission cables.

The above object of the invention is further obtained by means of use of a tower section according to any of above embodiments, use of a truss tower according to any of above embodiments, use of a truss tower assembly according to any of above embodiments, and use of a truss tower assembly for holding one or more transmission cables.

BRIEF DESCRIPTION OF DRAWINGS

In the following is described examples of preferred embodiments illustrated in the accompanying drawings, wherein.

DETAILED DESCRIPTION OF THE INVENTION

Figure 1A:
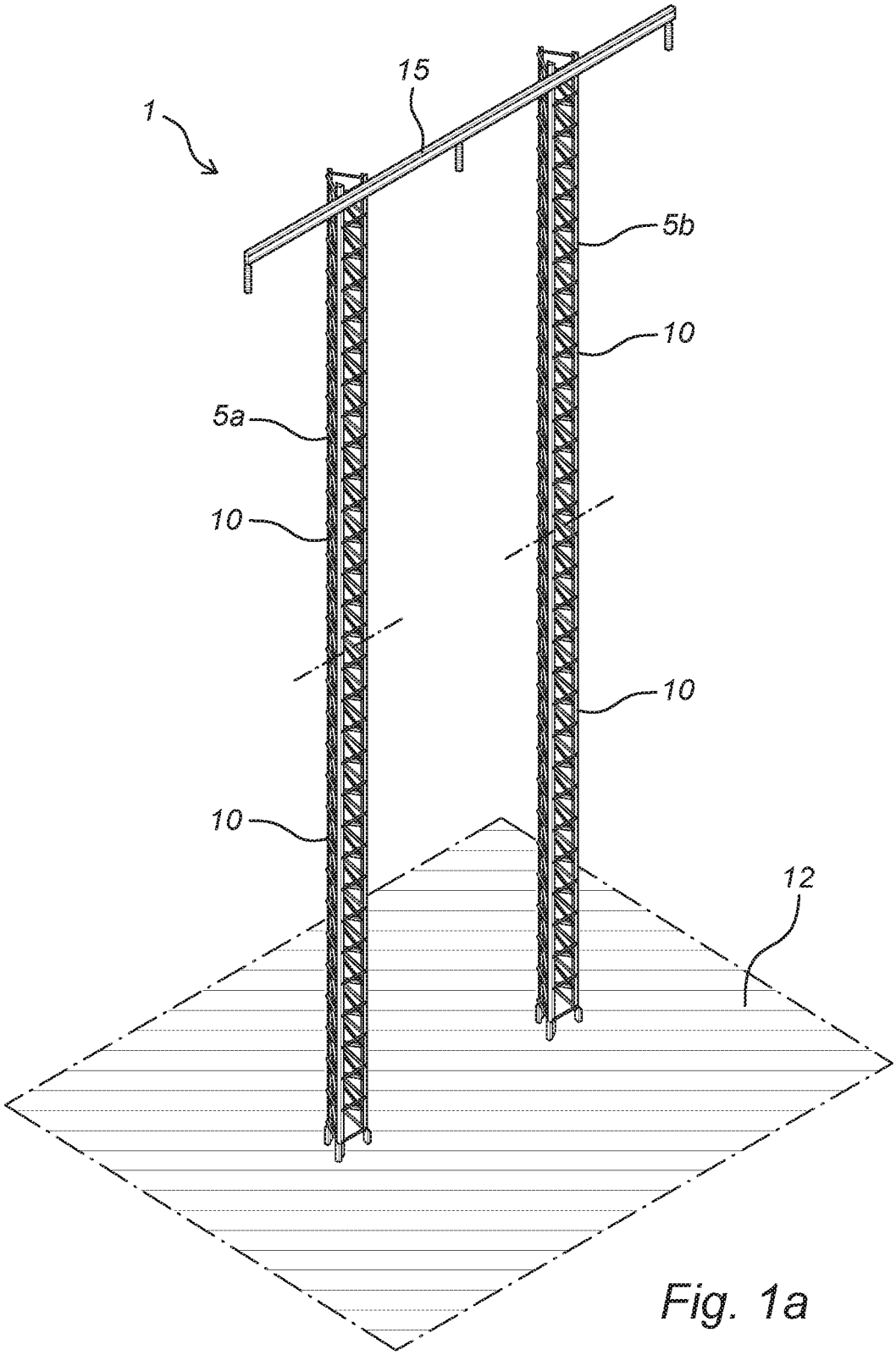
FIG. 1*a* discloses a truss tower assembly according to a first embodiment of the invention, wherein the truss tower assembly comprises two truss towers.

FIG. 1*a* shows a truss tower assembly 1 comprising a first truss tower 5*a* and a second truss towers 5*b* according to a first embodiment of the invention.

The truss towers 5*a*, 5*b* are comprised by a plurality of tower sections 10. In the disclosed example, for purpose of simplicity, the truss towers 5*a*, 5*b* are disclosed each comprising two tower sections 10. The two or more tower sections 10 are connected at their end portions to form the truss towers 5*a*, 5*b*.

The first truss tower 5*a* and the second truss tower 5*b* are configured to be supported spaced apart on a bearing surface 12. The truss tower assembly 1 further comprises a transverse bar 15 arranged between an end portion of the first truss tower 5*a* and an end portion of the second truss tower 5*b*. The truss tower assembly 1 is for example used for holding one or more transmission cables (not shown) and comprises in such case connection means for holding the one or more transmission cables connected to the transverse bar 15.

Figure 1B:
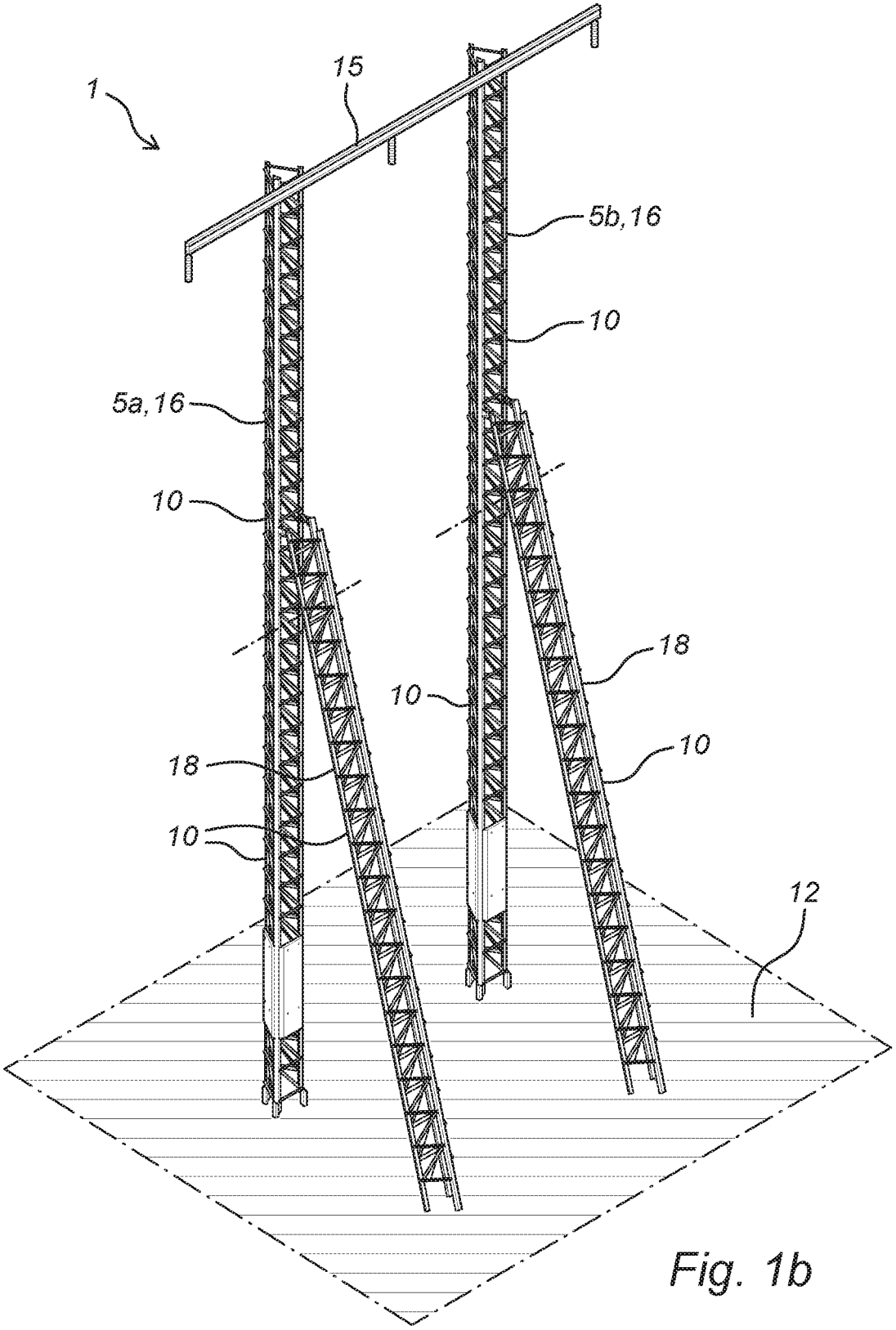
FIG. 1*b* discloses a truss tower assembly according to a second embodiment of the invention, wherein the truss tower assembly comprises two truss towers.

FIG. 1*b* shows a truss tower assembly 1 according to a second embodiment of the invention. The truss tower assembly 1 differs from the truss tower assembly 1 in FIG. 1*a* in that the truss towers 5*a*, 5*b* further comprises the combination of a spar post 16 and a stay bar 18 obliquely connected to the spar post 16 via a bracket or hinge. The connection between the spar post 16 and the stay bar 18 is disclosed in further detail in FIG. 1*c*. Locally connecting such a stay bar (18) obliquely to spar post (16) is particularly beneficial when the spar post (16) is at least partly formed by metal, as metal has a better local strength than composite or wood The stay bar 18 has the function of supporting the vertical orientation of the spar post 16. In the disclosed embodiment both the spar post 16 and the stay bar 18 are comprised by one or more tower sections 10.

Figure 1C:
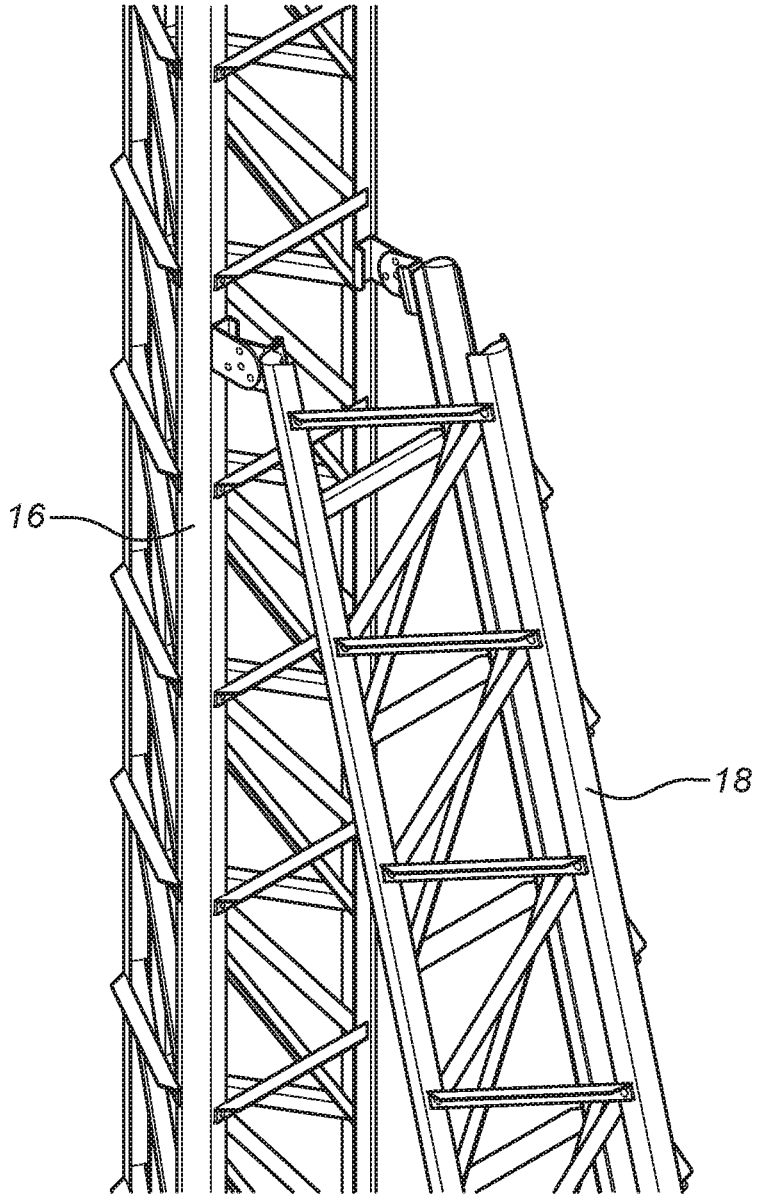
FIG. 1*c* discloses a connection between a spar post and a stay bar of one of the truss towers in FIG. 1*b;*
Figure 2A:
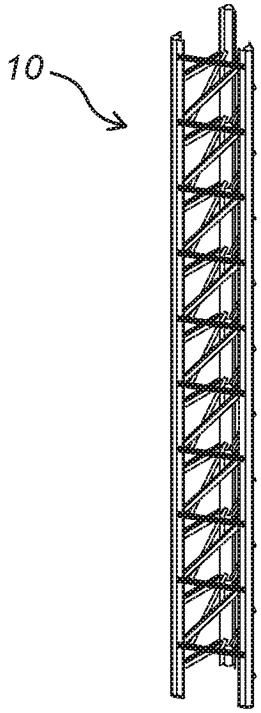
FIG. 2*a* discloses a tower section according to an embodiment of the invention.
Figure 2B:
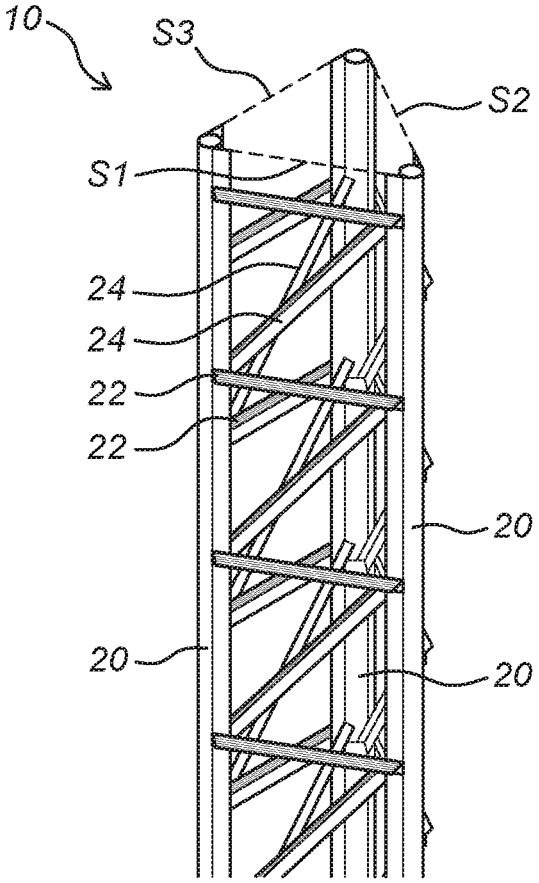
FIG. 2*b* discloses the tower section in FIG. 2*a* in further details.

FIG. 2*a* shows an embodiment of the tower section 10 used in the truss tower assembly 1 in FIG. 1*a*-1*c*. FIG. 2*b* shows the tower section 10 in further details.

The tower section 10 comprises three elongated corner beams 20 arranged in parallel and spaced apart in an equidistant triangle form indicated by dashed lines. The tower section 10 further comprises a plurality of transverse beams 22 connected perpendicularly to adjacent corner beams 20. Thereby, respective first side S1, second side S2 and third side S3 are formed confining the space of the triangle form.

The transverse beams 22 are distributed along the sides S1, S2, S3 so that the transverse beams 22 of one of the sides S1, S2, S3 are arranged offset to the transverse beams 22 of the other sides S1, S2, S3.

The corner beams 20 are configured to bear the axial load of the truss tower 5*a*, 5*b*. The transverse beams 22 connect the corner beams 20 so that the spacing between the corner beams 20 is fixed when the tower section 10 is subjected to bending or torsion.

By the offset configuration of the transverse beams 22 of different sides S1, S2, S3 of the tower section 10, the structural strength of the tower section 10 in regard to bending or torsion is improved. Thereby, also the weight of the tower section 10 is reduced and the transport and assembly operation are facilitated. Such as transportation by a helicopter.

Preferably. the transverse beams 22 are distributed equidistant along the sides S1, S2, S3 and with an equidistant offset between the sides S1, S2, S3, which provides a homogenous strength of the tower section 10 along its length.

The offset distribution of the transverse beams 22 also facilitates a person climbing the truss tower using the transverse beams 22.

In the disclosed embodiment, the tower section 10 further comprises a plurality of bracing beams 24 connected obliquely to adjacent corner beams 20. The bracing beams 24 are configured to further provide strength and stability to the truss tower 10.

The tower section 5*a*, 5*b* has for example a length in an interval 5 to 7 meters and with thickness in an interval 4 to 8 mm of the corner beams 20, the transverse beams 22 and the bracing beams 24. The tower section 5*a*, 5*b* has preferably a weight in an interval 80 to 160 kg.

In regards to the truss tower assembly 1 in FIG. 1, transverse bar 15 is preferably arranged extending in parallel with a side S1, S2, S3 of a tower section 10 of the first truss tower 5*a* and in parallel with a side S1, S2, S3 of a tower section 10 of the second truss tower 5*b*.

For example, the transverse bar 15 is arranged extending along the first side S1 of the first truss tower 5*a* and correspondingly along the first side S1 of the second truss tower 5*b*. Thereby, the stresses subjected to the two truss towers 10*a*, 10*b* from an entity connected to the transverse bar 15 are preferable for the truss tower assembly 1.

Figure 3:
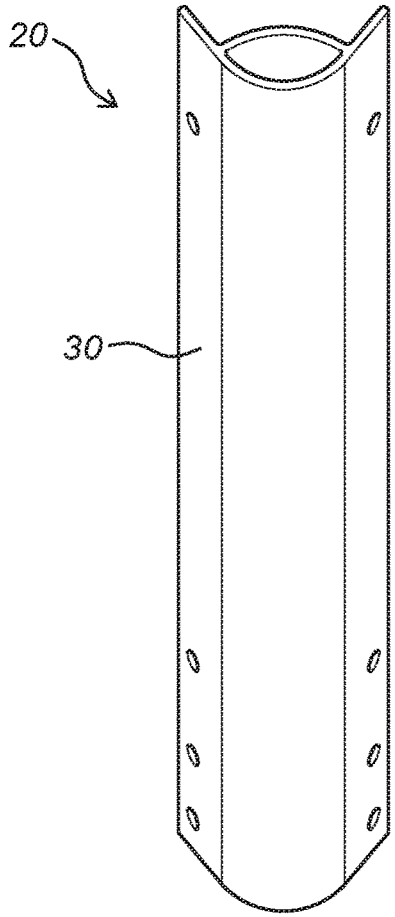
FIG. 3 discloses an example of a corner beam of the tower section in FIG. 2*a;*

In FIG. 3 is an example of a corner beam 20 of the tower section 10 in FIG. 2*a* disclosed. The corner beam 20 comprises a closed tubular profile and is provided with fins 30 for attachments of the transverse beams 22 and the bracing beams 24. The corner beam 20 preferably comprises an extruded aluminium material.

Figure 4:
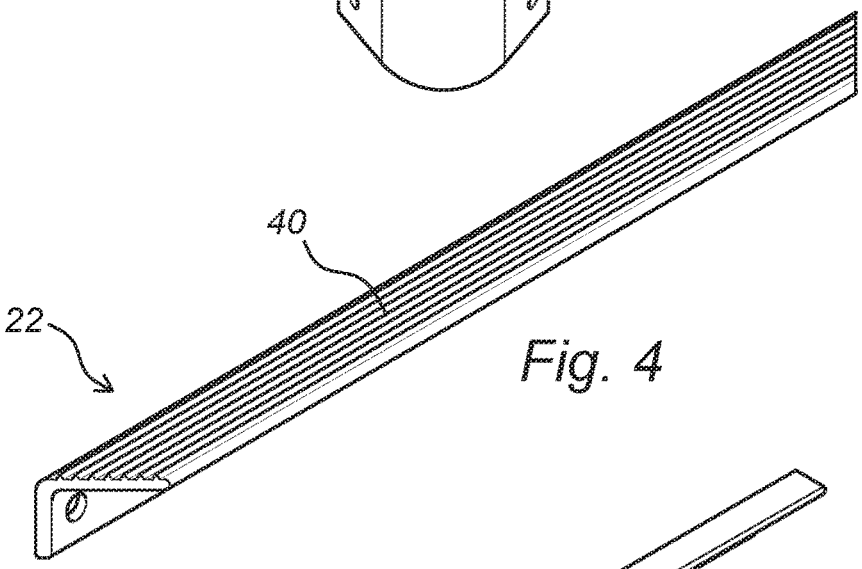
FIG. 4 discloses an example of a transverse beam of the tower section in FIG. 2*a*.

In FIG. 4 is an example of a transverse beam 22 of the tower section 10 in FIG. 2*a* disclosed. The transverse beam 22 comprises an L-shaped profile with friction enhancing surface 40 for facilitating climbing the truss tower 10 using the transverse beams 22. The friction enhancing surface 40 comprises for example friction ridges or friction notches. The transverse beam 22 preferably comprises an extruded aluminium material.

Figure 5:
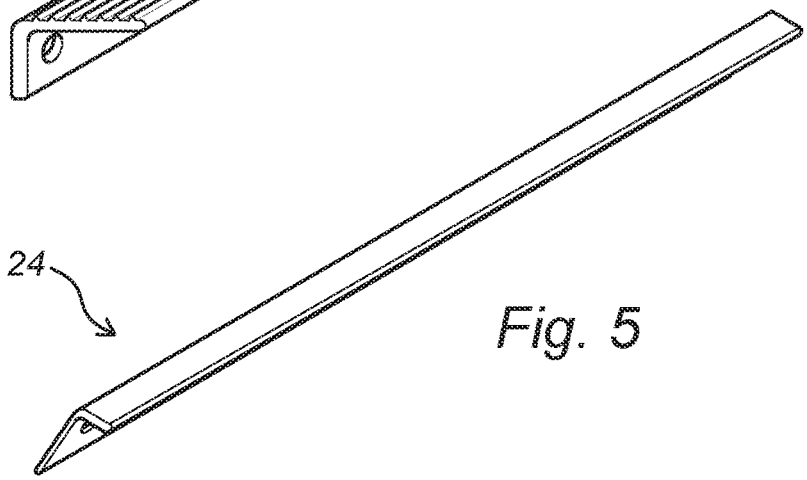
FIG. 5 discloses an example of a bracing beam of the tower section in FIG. 2*a*.

In FIG. 5 is an example of a bracing beam 24 of the tower section 10 in FIG. 2*a* disclosed. The transverse beam 22 comprises an L-shaped profile. The bracing beam 24 preferably comprises an extruded aluminium material.

It should be noted that the above-mentioned embodiments illustrate rather than limit the invention, and that those skilled in the art will be able to design many alternative embodiments without departing from the scope of the appended claims.

For example, it shall be understood that more than three elongated corner beams 20 may be used with increasing number of surfaces of the tower section 10, for example four, six or eight corner beams 20. It shall further be understood that the feature relating to the arrangement of the transverse bar 15 parallel with a side S1, S2, S3 of the tower section 10 of the first truss tower 5*a* and parallel with a side S1, S2, S3 of a tower section 10 of the second truss tower 5*b* is independent to the feature of the offset arrangement of the transverse beams 22. It shall further be understood that the truss tower assembly 1 in FIG. 1*a*-*c* preferably mainly comprises a structural metal, such as aluminium, and that truss tower assembly 1 made of a composite material or wood would be difficult to realize.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

The invention claimed is:

1. A tower section for a truss tower, the tower section comprising:

three or more elongated corner beams arranged in parallel and spaced apart, and a plurality of transverse beams connected perpendicularly to adjacent corner beams in the three or more elongated corner beams, thereby forming respective three or more sides, the plurality of transverse beams being distributed equidistantly along the three or more sides and so that the transverse beams on at least one of the three or more sides are arranged at an equidistant offset relative to the transverse beams on of the other remaining sides of the three or more sides, wherein the equidistant offset is configured to enable a person climbing the tower section, wherein each of the three or more elongated corner beams comprises a closed tubular profile having fins attached to the plurality of transverse beams, and wherein the three or more elongated corner beams and the plurality of transverse beams are configured to support the person climbing the tower section.

2. The tower section according to claim 1, wherein the plurality of transverse beams comprises friction enhancing surfaces.

3. The tower section according to claim 1, further comprising a plurality of bracing beams connected obliquely to the adjacent corner beams.

4. The tower section according to claim 1, wherein the transverse beams in the plurality of transverse beams comprise L-shaped profiles.

5. The tower section according to claim 3, wherein the bracing beams in the plurality of bracing beams comprise L-shaped profiles.

6. The tower section according to claim 3, wherein at least one of the three or more elongated corner beams, the plurality of transverse beams and the plurality of bracing beams comprises an extruded aluminium material.

7. A truss tower assembly for holding one or more transmission cables, wherein the truss tower assembly comprises a first truss tower and a second truss tower, each the first and second truss towers comprising a tower section, wherein the tower section comprising:

three or more elongated corner beams arranged in parallel and spaced apart, and a plurality of transverse beams connected perpendicularly to adjacent corner beams in the three or more elongated corner beams, thereby forming respective three or more sides, the plurality of transverse beams being equidistantly distributed along the three or more sides and so that the transverse beams on at least one of the three or more sides are arranged at an equidistant offset relative to the transverse beams on the remaining sides of the three or more sides, wherein the equidistant offset is configured to enable a person climbing the truss tower assembly, wherein each of the three or more elongated corner beams comprises a closed tubular profile having fins attached to the plurality of transverse beams, wherein the three or more elongated corner beams and the plurality of transverse beams are configured to support the person climbing the truss tower assembly, and wherein the first truss tower and the second truss tower are configured to be supported spaced apart on a bearing surface, the truss tower assembly further comprising a transverse bar arranged between an end portion of the first truss tower and an end portion of the second truss tower.

8. The truss tower assembly according to claim 7, wherein the transverse bar is arranged extending parallel with one of the three or more sides of a tower section of the first truss tower and parallel with a one of the three or more sides of a tower section of the second truss tower.

9. The truss tower assembly according to claim 7, wherein the transverse bar is configured to hold one or more transmission cables.

10. The truss tower assembly according to claim 8, wherein the transverse bar is configured to hold one or more transmission cables.

11. The truss tower assembly according to claim 10, wherein the three or more elongated corner beams and the plurality of transverse beams are configured to support the person to climb the truss tower assembly up to the transverse bar so as to have access the one or more transmission cables.

12. The truss tower assembly according to claim 7, wherein the tower section is one of two or more tower sections which are identical and stacked on top of each other.

13. The truss tower assembly according to claim 3, wherein the fins are attached to the plurality of bracing beams.

* * * * *